United States Patent [19]

Takahashi et al.

[11] 3,967,484

[45] July 6, 1976

[54] METHOD OF MANUFACTURING A LOW ENERGY-LOSS WAVEGUIDE CIRCUIT ELEMENT

[75] Inventors: Soji Takahashi; Hiroshi Okada, both of Kodaira, Japan

[73] Assignees: Hitachi Electronics, Ltd.; Hitachi, Ltd., both of Japan

[22] Filed: Dec. 26, 1974

[21] Appl. No.: 536,474

Related U.S. Application Data

[63] Continuation-in-part of Ser. No. 327,160, Jan. 26, 1973, abandoned.

[30] Foreign Application Priority Data

Jan. 26, 1972 Japan ..... 47-9098

[52] U.S. Cl. ..... 72/47; 29/DIG. 47; 29/600; 72/258; 72/267; 72/700

[51] Int. Cl.[2] ..... B21C 23/22; B21C 23/18; H01P 11/00

[58] Field of Search ..... 29/DIG. 47, 480, 600, 29/601; 72/47, 258, 267, 358, 359, 700; 333/83 R

[56] References Cited

UNITED STATES PATENTS

| | | | |
|---|---|---|---|
| 2,471,663 | 5/1949 | Tietz | 29/480 |
| 2,953,247 | 9/1960 | Walter et al. | 72/258 |
| 2,986,273 | 5/1961 | Bardgett | 29/480 X |
| 3,184,945 | 5/1965 | Hornak et al. | 72/267 X |
| 3,197,857 | 8/1965 | Nippert | 29/480 |
| 3,503,243 | 3/1970 | Katz | 72/700 X |
| 3,648,351 | 3/1972 | Kibler | 72/258 X |

FOREIGN PATENTS OR APPLICATIONS

| | | | |
|---|---|---|---|
| 840,830 | 7/1938 | France | 72/267 |

*Primary Examiner*—C.W. Lanham
*Assistant Examiner*—E. M. Combs
*Attorney, Agent, or Firm*—Craig & Antonelli

[57] ABSTRACT

A method of manufacturing low energy-loss waveguide circuit elements in which a film of metal with a low resistivity is joined to a base metal by thermal pressing or electric plating, and a hard male die of a desired shape is pressed into the base metal from above the metal film, whereby a plastic strain is caused in the base metal thereby to form a recessed portion in the base metal having an internal surface covered with the low resistivity metal.

6 Claims, 6 Drawing Figures

METHOD OF MANUFACTURING A LOW ENERGY-LOSS WAVEGUIDE CIRCUIT ELEMENT

CROSS-REFERENCE TO RELATED APPLICATION

This is a continuation-in-part of application Ser. No. 327,160 filed on Jan. 26, 1973 , now abandoned.

BACKGROUND OF THE INVENTION

1. Field of the Invention

This invention relates to a method of manufacturing a waveguide circuit element with a low energy-loss suitable for use in ultrashort wave bands.

2. Description of the Prior Art

It is generally required to minimize the electric loss on the internal surface of a recessed portion of a waveguide circuit element for ultrashort wave band along which electric waves are transmitted.

In order to achieve this purpose, the accuracy with which the internal surface of the recessed portion is made up is of primary importance in the manufacture of the waveguide circuit element. In this connection, the dimensional error of the internal surface of the recessed portion is required to be maintained not more than several microns and also the internal surface of the recessed portion should be mirror-finished in such a manner that the difference in height between the highest and lowest portions of the surface excepting an abnormally high or low portion is not more than 0.2 $\mu$m. Further, it is desirable that a metal layer constituting the internal surface should be low in resistivity as far as possible.

In the conventional method of manufacturing a waveguide circuit element such as a cavity resonator, a base metal of copper, brass or phosphorus bronze is hollowed out on a machine such as a lathe to form a recess and then the internal surface of the recessed portion is plated with a metal with a low resistivity. As an alternative, a male die adapted to fit a desired recess is made of aluminum or stainless steel and a copper electro-forming is effected on it, followed by the removal of the male die and the electroplating of a metal with a low resistivity on the internal surface of the recessed portion.

The conventional methods described above have the following disadvantages:

1. The portion of the base metal where the electroplating is effected is the internal surface of the base metal and therefore it is often difficult to finish that portion uniformly.
2. The manufacturing processes are complicated. For these reasons, the accuracy in dimension and shape of the recess as well as the fineness of the surface thereof is reduced, and also a high resistivity of the surface of the recessed portion results, making it difficult to obtain a low energy-loss cavity resonator.

SUMMARY OF THE INVENTION

Accordingly, it is an object of the present invention to provide a method of manufacturing a waveguide circuit element having a recessed portion with an internal surface where electric waves are transmitted with a low energy-loss.

DESCRIPTION OF THE PREFERRED EMBODIMENT

Figure 1:
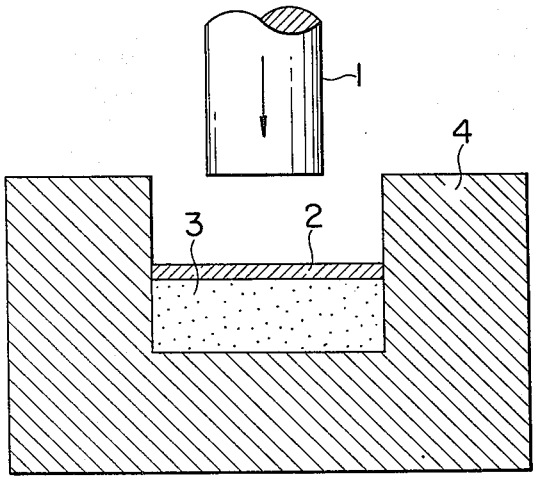
FIG. 1 is a diagram showing a longitudinal section of a waveguide circuit element with a recessed portion in process for explaining the method of manufacture according to the present invention.

In FIG. 1, the reference numeral 1 shows a hard male die of a desired shape, the numeral 2 a film of metal of low resistivity such as silver, gold or the like, the numeral 3 a base metal of copper or the like and the numeral 4 a female die.

Figure 2:
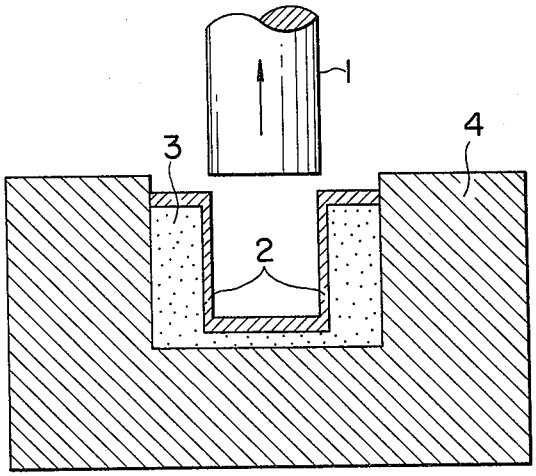
FIG. 2 is a diagram of a longitudinal section of the waveguide circuit element processed according to the method of the invention.

The low-resistivity metal film 2 is joined to the base metal 3 by thermal pressing or electroplating. The hard male die 1 of steel or the like is pressed into the base metal through the metal film 2. A plastic strain is caused in the base metal into which the male die has been pressed, thus forming a recessed portion with an internal surface formed by the low-resistivity metal film 2 as shown in FIG. 2. In the process, if the flow stress of the metal film 2 is substantially equal to or lower than that of the bare metal 3, and the ratio of the former to the latter is not more than 1.5 (in other words, the ratio of the flow stress of the base metal to that of the metal film $\geqq$ 2/3), the metal film 2 is extended over the internal surface of the formed recessed portion with a uniform thickness without being torn off.

Figure 3:
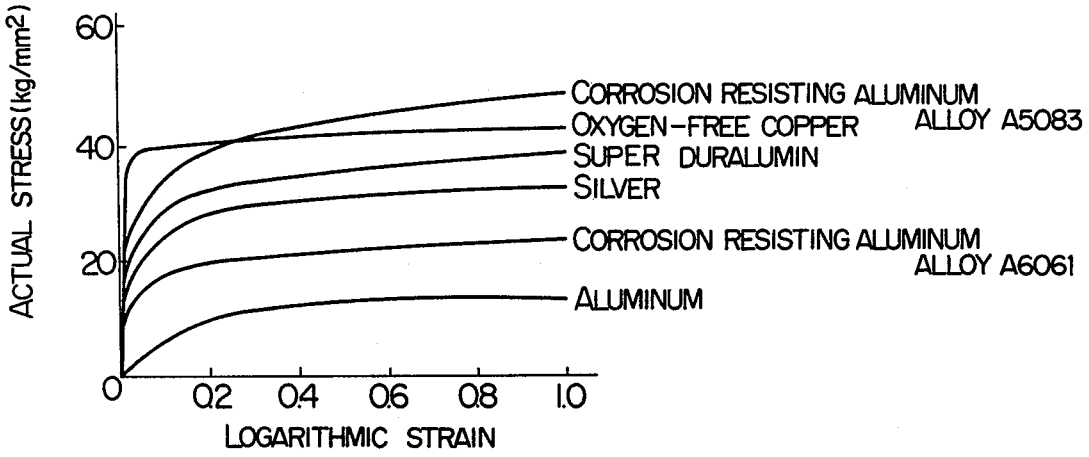
FIG. 3 is a graph showing flow stresses of various kind of materials for a base metal and silver for a metal film.
Figure 4:
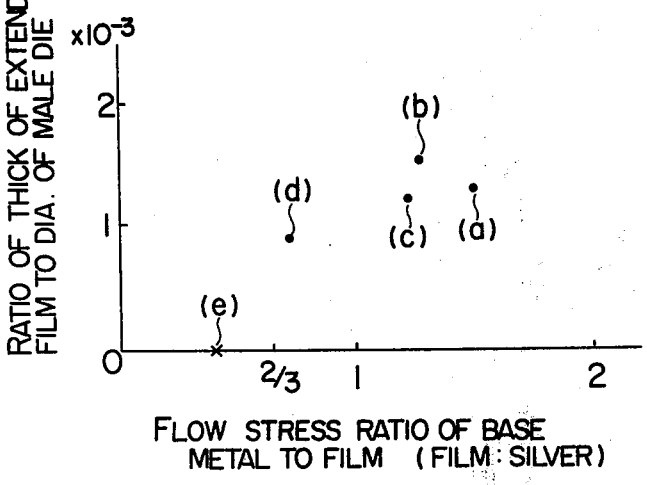
FIG. 4 is a graph showing state of the extended silver film on the internal surface of the recessed portion for the individual base metal materials shown in FIG. 3.

FIG. 3 shows flow stresses of various kind of materials considered in use for the base metal 3 in comparison with silver which can be used for the metal film 2. The ordinate of FIG. 3 indicates actual stress applied to the materials in a compression test thereof, and the abscissa indicates logarithmic strain in the material, which is expressed by loge ($ho/h$) where $ho$ and $h$ designate heights of a test sample of the material before and after the compression test, respectively. As can be seen from this Figure, the flow stress of silver is higher than 1.5 times that of aluminum, while it is not higher than 1.5 times those of the other materials. An experiment was made in which silver was used for the material of the metal film 2 and aluminum, corrosion resisting aluminum alloy A6061, super duralumin A7075, oxygen-free copper, and corrosion resisting aluminum alloy A5083 were used for the material of the base metal 3, and in which a cylindrical male die was used as the male die 1. FIG. 4 shows the thickness of the extended silver film on the internal surface of the recessed portion in relation with the ratio of the flow stress of the base metal to that of the metal film. In this Figure, the ordinate indicates the ratio of the thickness of the extended silver film to the diameter of the male die while the abscissa indicates the ratio of the flow stress of the base metal to that of the metal film. As can be seen from FIG. 4, when aluminum was used for the base metal, i.e. in case the ratio of the flow stress of the base metal to that of the metal film is smaller than 2/3, the metal film (silver film) was torn off, while when the other metals, corrosion resisting aluminum alloy A6061, super duralumin A7075, oxygen-free copper, and corrosion resisting aluminum alloy A5083 were used for the base metal, i.e. in case the ratio of the flow stress of the base metal to that of the metal film is larger than 2/3, the metal film (silver film) was extended uniformly on the internal surface of the recessed portion without being torn off.

Figure 5:
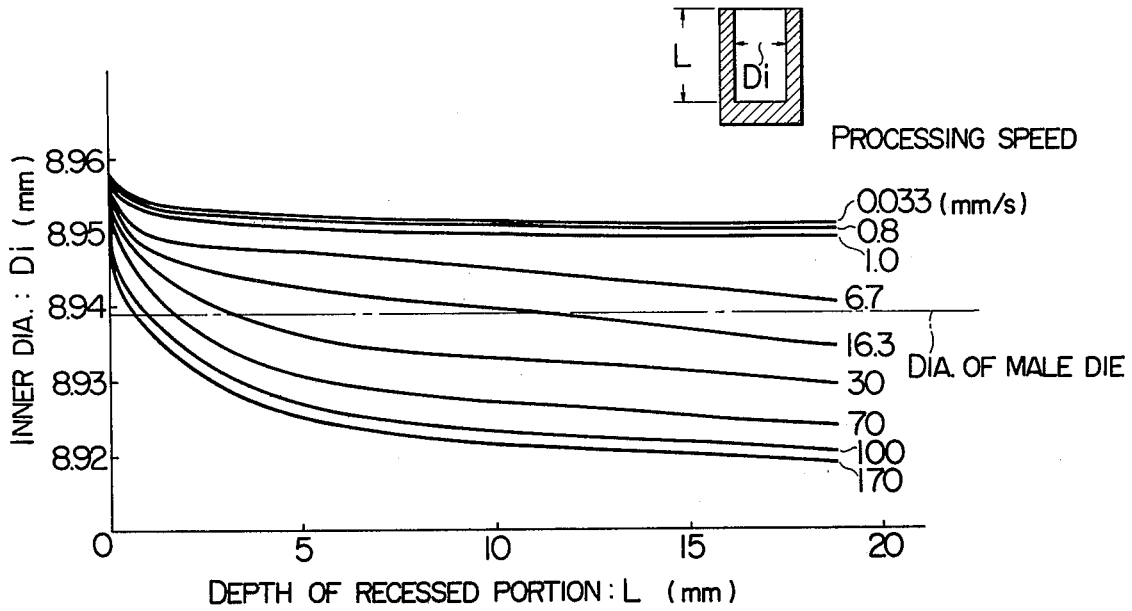
FIG. 5 is a graph showing variation, in the axial direction, in the inner diameter of the recessed portion in relation with various processing speeds at which a male die is pressed into the base metal.
Figure 6:
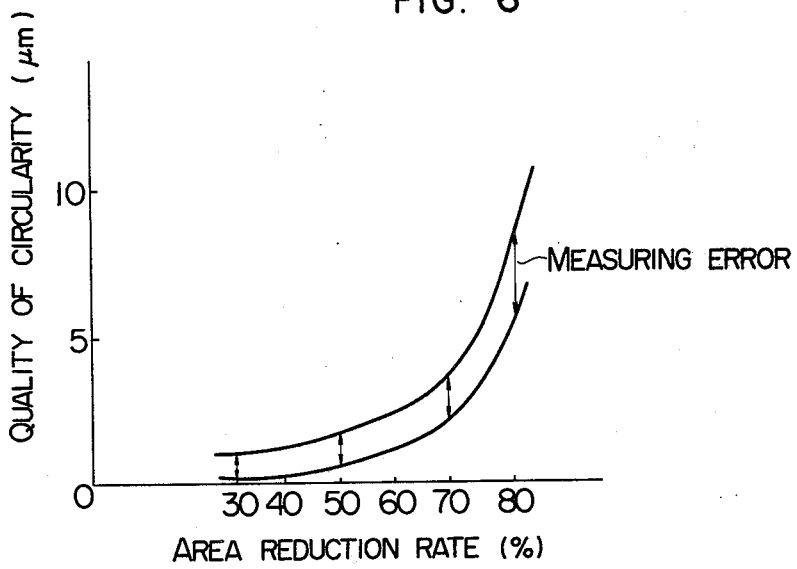
FIG. 6 is a graph showing quality of circularity of the recessed portion in relation with area reduction rate.

The internal surface of the recessed portion is the electric wave conductive surface which requires a high dimensional accuracy and high surface precision, and therefore it is necessary to properly determine the processing speed at which the male die 1 is pressed into the base metal 3 and the area reduction rate which is indicated by the ratio of the cross-sectional area of the male die 1 to the surface area of the base metal 3. Namely, when the processing speed is high, the recessed portion is deformed in the axial direction and the dimensional accuracy becomes deteriorated. This can be seen from FIG. 5. FIG. 5 shows variation, in the axial direction, in the inner diameter of the recessed portion formed at various processing speeds. As can be seen from this Figure, the processing speed of not higher than about 1 mm/sec is preferable for obtaining a high dimensional accuracy such that the dimensional error of the internal surface of the recessed portion is maintained within several microns required for the electric wave conductive surface. Further, when the area reduction rate is large, and about 80 percent or larger, the side wall of the recessed portion becomes thin and the shape of the recessed portion is easily deformed, so that the quality of circularity of the recess becomes deteriorated. FIG. 6 shows this fact. In FIG. 6, the ordinate indicates the quality of circularity of the recess, while the abscissa indicates the area reduction rate. The quality of circularity is expressed by the maximum inner diameter minus the minimum inner diameter. As can be seen from FIG. 6, the area reduction rate is to be determined to 70 percent or smaller, and preferably it is 30 percent or smaller, which is attained by a hobbing process.

In order to attain a high surface precision, i.e. a mirror-finishing of the internal surface such as mentioned above, the application of plastic strain is carried out by a cold processing. This is because such mirror-finishing cannot be attained by a hot processing, since in a hot processing an oxide film is easily caused on the surface of a processed metal and particles of processed metal material become large so that the surface precision becomes inferior. Thus, it is preferable for attaining a high dimensional accuracy and high surface precision that the application of plastic strain is carried out by a cold hobbing processing.

In this way, a conductive surface of low resistivity along which electric waves are transmitted is formed inside the recessed portion of the base metal 3, thereby to produce a desired waveguide circuit element.

It will be needless to say that the male die 1 agrees in a shape desired to the surface of the recessed portion as much as possible so far as it can be recollected after being pressed into the base metal 3. The fineness of the conductive surface thus produced is equivalent to or only slightly inferior to that of the surface of the male die 1 and therefore a sufficiently high precision of the conductive surface is obtained by finishing the male die satisfactorily. Also, it will be recognized that only one set of the male die 1 and female die 4 is sufficient for fabricating a great number of such waveguide circuit elements, and accordingly deviation in dimensions of the recessed portions and finishing of the conductive surfaces of the fabricated waveguide circuit elements can be made very small, which results in possiblity of processing with a high dimensional accuracy and high surface precision as compared with the prior art methods. Further, the waveguide circuit element according to the invention thus produced has the advantages of low resistivity and high anticorrosiveness compared with the conventional waveguide circuit element. In addition, the number of steps needed for the manufacture of the circuit element is reduced.

A similar method may be considered, in which the metal film 2 is only laid on the surface of the base metal 3 and the male die 1 is pressed into the base metal 3 through the metal film 2. In such method, however, the adhesiveness of the metal film 2 to the base metal 3 becomes inferior to the method of this invention and deviates in accordance with the extent of pre-treating such as cleaning the surfaces of the metal film 2 and the base metal 3. Therefore, it is comparatively difficult to expect a good stabilized operation to a waveguide circuit element fabricated by such method.

It will be understood from the above description that a low energy-loss waveguide circuit element with high conductivity is produced by employing the method of the present invention and thus by the use of this waveguide circuit element it is possible to manufacture a high-performance ultrashort wave device including a wavemeter of the cavity resonator type.

We claim:

1. A method of manufacturing a low-energy loss waveguide circuit element comprising the steps of:

joining a low resistivity metal film to a base metal structure, wherein the ratio of flow stress of said metal film to flow stress of said base metal is not larger than 1.5, and forming a conductive internal surface inside a recessed portion within said base metal by pressing a male die of a predetermined shape into said base metal through said low resistivity metal film by cold processing at a low processing speed of not higher than 1 mm/sec and an area reduction rate of not larger than 70 percent so as to cause a plastic strain in the base metal, said recessed portion being formed with a thick side wall, said internal surface being formed of a uniform thin layer formed of said low resistivity metal film and said internal surface being formed with a surface finish wherein the difference in height between the highest and lowest portions of said surface is not more than 0.2 $\mu$m such that said internal surface of said recessed portion constitutes a conductive surface for transmission of electric waves.

2. A method of manufacturing a waveguide circuit element according to claim 1, in which said step of joining said metal film to said base metal is performed by thermal pressure of a film of said metal.

3. A method of manufacturing a waveguide circuit element according to claim 1, in which said step of joining said metal film to said base metal is performed by electroplating.

4. A method of manufacturing a waveguide circuit element according to claim 1, in which said area reduction rate is not larger than 30 percent.

5. A method of manufacturing a waveguide circuit element according to Claim 1, in which said low resistivity metal film is a material selected from the group consisting of silver and gold.

6. A method of manufacturing a waveguide circuit element according to claim 1, in which said low resistivity metal film is silver, and said base metal is a material selected from the group consisting of corrosion resisting aluminum alloy A6061, super duralumin A7075, oxygen-free copper, and corrosion resisting aluminum alloy A5083.

* * * * *